US011549265B2

(12) United States Patent
Patki et al.

(10) Patent No.: US 11,549,265 B2
(45) Date of Patent: Jan. 10, 2023

(54) ROOF RIDGE OR HIP COVERING ELEMENT AND METHOD FOR MANUFACTURING A ROOF RIDGE OR HIP COVERING ELEMENT

(71) Applicant: Dal-Tile Corporation, Dallas, TX (US)

(72) Inventors: Rahul Patki, Richardson, TX (US); Raul Rodriguez, Dallas, TX (US); Claudio Caselli, Dallas, TX (US)

(73) Assignee: Dal-Tile Corporation, Dallas, TX (US)

( * ) Notice: Subject to any disclaimer, the term of this patent is extended or adjusted under 35 U.S.C. 154(b) by 0 days.

(21) Appl. No.: 17/265,223

(22) PCT Filed: Aug. 7, 2019

(86) PCT No.: PCT/US2019/045455
§ 371 (c)(1),
(2) Date: Feb. 2, 2021

(87) PCT Pub. No.: WO2020/033511
PCT Pub. Date: Feb. 13, 2020

(65) Prior Publication Data

US 2021/0301533 A1 Sep. 30, 2021

Related U.S. Application Data

(63) Continuation of application No. 16/100,900, filed on Aug. 10, 2018, now Pat. No. 10,941,572.

(51) Int. Cl.
*E04D 1/30* (2006.01)

(52) U.S. Cl.
CPC ..... *E04D 1/30* (2013.01); *E04D 2001/305* (2013.01)

(58) Field of Classification Search
CPC ..... E04D 1/30; E04D 2001/305; E04D 1/16; E04D 1/365
See application file for complete search history.

(56) References Cited

U.S. PATENT DOCUMENTS 1,549,723 A 8/1925 Mattison
2,730,969 A 1/1956 Perry
3,977,141 A * 8/1976 Peters ..... E04D 1/265 52/534
4,404,783 A * 9/1983 Freiborg ..... E04D 1/26 52/98

(Continued)

FOREIGN PATENT DOCUMENTS

EP 0117391 B1 4/1987
EP 2172600 A1 4/2010

(Continued)

OTHER PUBLICATIONS

International Search Report and Written Opinion for International (PCT) Application No. PCT/US2019/040218 dated Oct. 1, 2019.

(Continued)

*Primary Examiner* — Babajide A Demuren
(74) *Attorney, Agent, or Firm* — Troutman Pepper Hamilton Sanders LLP; James E. Schutz; Chris N. Davis

(57) ABSTRACT

A roof ridge or hip covering element comprising a first flat body, a second flat body, and a flexible sheet for joining together the first and second flat body.

11 Claims, 3 Drawing Sheets

(56) References Cited

U.S. PATENT DOCUMENTS 4,464,872 A * 8/1984 Eaton ..... E04C 2/10 52/518
4,888,932 A 12/1989 Beare et al.
5,365,711 A * 11/1994 Pressutti ..... E04D 1/30 52/553
5,685,931 A 11/1997 Kakamu et al.
6,125,602 A 10/2000 Freiborg
6,182,400 B1 * 2/2001 Freiborg ..... E04D 1/30 52/518
6,351,913 B1 3/2002 Freiborg et al.
7,596,919 B1 * 10/2009 Vande Hey ..... E04D 1/2916 52/630
8,371,072 B1 2/2013 Shanes et al.
2002/0000068 A1 * 1/2002 Freiborg ..... E04D 1/30 29/897
2002/0011043 A1 1/2002 Freshwater et al.
2004/0055240 A1 3/2004 Kiik et al.
2004/0128929 A1 7/2004 Moen
2004/0159062 A1 * 8/2004 Donlin ..... E04F 13/0864 52/518
2004/0187434 A1 9/2004 Podirsky
2005/0262784 A1 * 12/2005 Justice ..... E04F 13/0864 52/287.1
2005/0284339 A1 12/2005 Brunton et al.
2007/0266665 A1 11/2007 Todd et al.
2008/0078132 A1 4/2008 Jolitz
2008/0229695 A1 * 9/2008 Kalkanoglu ..... E04D 1/29 52/553
2009/0255202 A1 10/2009 Heidemann
2017/0218632 A1 * 8/2017 Patki ..... E04D 1/16
2019/0177978 A1 6/2019 Grubka et al.

FOREIGN PATENT DOCUMENTS

GB 2456008 A 7/2009
WO 2015092745 A1 6/2015

OTHER PUBLICATIONS

International Search Report and Written Opinion for International (PCT) Application No. PCT/US2019/045455 dated Nov. 13, 2019.

* cited by examiner

ROOF RIDGE OR HIP COVERING ELEMENT AND METHOD FOR MANUFACTURING A ROOF RIDGE OR HIP COVERING ELEMENT

CROSS-REFERENCE TO RELATED APPLICATIONS

This application is a National Stage Entry of, and claims priority to, PCT Patent Application No. PCT/US2019/045455 filed Aug. 7, 2019, which is a continuation of, and claims priority to, U.S. patent application Ser. No. 16/100,900, filed Aug. 10, 2018, the disclosure of which is herein incorporated by reference in its entirety.

BACKGROUND

1. Technical Field

The present invention relates to a roof ridge or hip covering element and to a method for installing said roof tile. The invention further relates to a roof covering comprising roof ridge or hip covering element.

2. Background

As it is known a roof is formed by flaps or panels having different slopes that meet each other in couples in correspondence of a peak. If said peak is horizontal is called ridge, whereas if the peak is inclined it is called hip. Said ridge and hip are usually covered by rigid covering element, for example made of metal, that are properly shaped in order to be adapted to the slopes of the roof planes. Thus, the manufacturing of such covering elements is complicated and expensive.

EP 0 117 391 B1 disclose a roof hip or ridge covering element comprising a bowed rigid body to be installed on a roof structure in correspondence of a ridge or hip of the roof. In order to adapt the covering element to the pitch of the roof, EP 0 117 391 B1 proposes to use a flexible strip that extends beyond the edges of the covering element. Anyway, said flexible strip is visible so that the aesthetic appearance of the roof is affected.

BRIEF SUMMARY

In one aspect, the present invention provides a roof ridge or hip covering element comprising a first flat body; a second flat body; and a flexible sheet for joining the first flat body and the second flat body together.

In another aspect, the present invention provides a method for manufacturing a roof ridge or hip covering element comprising the steps of: providing a flat piece; cutting the flat piece thereby obtaining a first flat body and a second flat body; providing a flexible sheet and joining together the first flat body and the second flat body via the flexible sheet thereby providing the roof ridge or hip covering element.

In another aspect, the present invention provides a roof ridge or hip covering element comprising a first flat body; a second flat body; and a connecting element for joining together the first flat body and the second flat body, and wherein the connecting element is configured for adjusting an angle between the first flat body and the second flat body.

These and other objects, features and advantages of the present invention will become more apparent upon reading the following specification in conjunction with the accompanying description, claims and drawings.

BRIEF DESCRIPTION OF THE DRAWINGS

The following non-limiting and exemplary figures are provided to show several possible forms of embodiments according to the disclosure.

DETAILED DESCRIPTION

Figure 1:
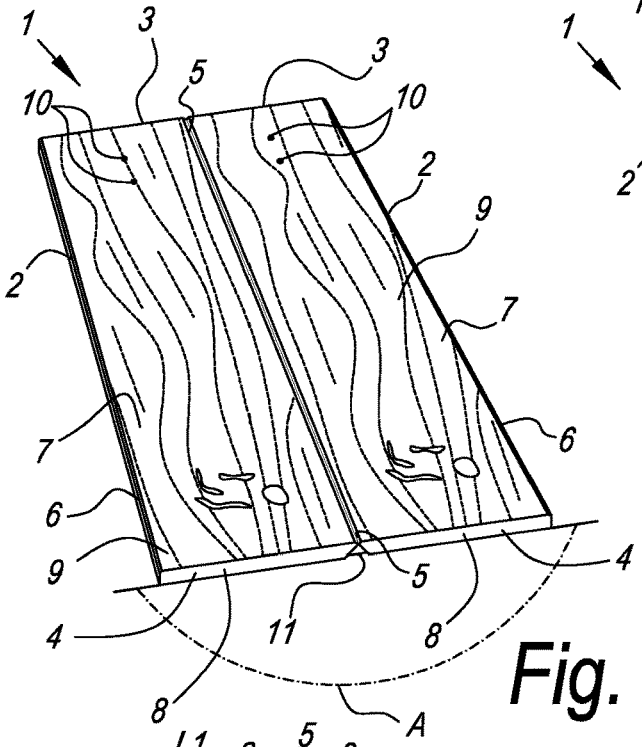
FIG. 1 represents a perspective view of a hip and ridge covering element according to the present disclosure in a first configuration.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named. In other words, the terms "a," "an," and "the" do not denote a limitation of quantity, but rather denote the presence of "at least one" of the referenced item.

As used herein, the term "and/or" may mean "and," it may mean "or," it may mean "exclusive-or," it may mean "one," it may mean "some, but not all," it may mean "neither," and/or it may mean "both." The term "or" is intended to mean an inclusive "or."

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose. It is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value. Further, the term "about" means within an acceptable error range for the particular value as determined by one of ordinary skill in the art, which will depend in part on how the value is measured or determined, i.e., the limitations of the measurement system.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described hereinafter as making up the various elements of the present invention are intended to be illustrative and not restrictive. Many suitable materials that would perform the same or a similar function as the materials described herein are intended to be embraced within the scope of the invention. Such other materials not described herein can include, but are not limited to, materials that are developed after the time of the development of the invention, for example. Any dimensions listed in the various drawings are for illustrative purposes only and are not intended to be limiting. Other dimensions and proportions are contemplated and intended to be included within the scope of the invention.

Embodiments of the Invention

The present invention aims in the first place at an alternative roof ridge or hip covering element, of the aforementioned type, whereby, according to various preferred embodiments, solutions are offered for problems with roof tiles known in the art.

Thereto, the present invention, according to a first independent aspect, relates to a roof ridge or hip covering element comprising a first and a second flat body and comprising a flexible sheet for joining together the first and the second flat body. Thank to this solution the angle between the two flat bodies may be regulated so that the covering element is adaptable to any roof pitch. Moreover, since the flexible sheet joins the flat bodies it may be hidden by said flat bodies in order to not being visible from outside. Preferably the angle between the flat bodies is adjustable. For example, the flat bodies are joined only by the flexible sheet. For example, the angle between the flat bodies can take any value between 0° and 360°, for example between 90° and 180°.

The flexible sheet may be in form of a web, for example of a synthetic fiber or glass fiber. According to alternative embodiment the flexible sheet may be an impermeable sheet, for example of polyethylene or other polymeric material.

The flexible sheet is placed below the flat bodies so that it is hidden by the latter. Preferably, the flexible sheet is totally overlapped by the flat bodies. For example, the superficial dimension of the flexible sheet is equal or preferably smaller to the sum of the superficial dimensions of the two flat bodies. For example, it is preferred that the width of the flexible sheet, measured when laying on a flat surface, is smaller than the width of the covering element when laying on a flat surface. In this way the flexible sheet doesn't extend below the edges of the covering element so that it is not visible and doesn't adversely affect the aesthetic appearance of the roof covering, on the contrary since only the flat bodies are visible said aesthetic appearance is improved.

Within the meaning of the present application, with the term "length" of the covering element is intended that dimension that in use is substantially parallel to the direction of the hip or of the ridge on which the covering element is installed. Whereas with the term "width" of the covering element is intended that dimension that in use is substantially orthogonal to the direction of the hip or of the ridge on which the covering element is installed.

The flexible sheet is fixed to a lower surface of the first and second flat body. In particular a first part of the flexible sheet is fixed to the first flat body and a second part of the flexible sheet is fixed to the second flat body. It is also noted that the flat bodies are placed on a same face of the flexible sheet.

The flexible sheet is fixed to the flat bodies by means of a glue, for example epoxy glue, polyurethane glue or hot melt glue. According to an embodiment of the invention, the glue is provided in form of spots between the flexible sheet and the flat bodies, although it is not excluded that the glue is provided according to a pattern or in form of a uniform layer.

According to a preferred embodiment the, flat bodies comprise substantially the same structural features, i.e. they may differ mainly for aesthetic features like color or décor.

The flat body comprises a rectangular or trapezoidal shape. The flat body comprises an upper and a lower edge, parallel to the width of the flat body, an inner edge adapted to be faced toward the other flat body of the covering element, and an external edge opposite to the other flat body. In a preferred embodiment, the flat body comprises a trapezoidal shape having two opposite parallel edges, preferably the upper and the lower edge, and and two opposite and converging edges, preferably the inner and the external edge. Preferably, the inner edge is orthogonal to the upper and the lower edge, whereas the external edge is inclined with respect of the parallel edges of an angle that is different form 90°. Moreover, preferably, the converging edges converge each other toward the upper edge of the flat body, i.e. an edge that in use is adapted to be placed in an upper position with respect to the opposite edge, especially in case of a hip covering element. In other words, the upper edge is shorter than the lower edge. It is noted that, in a preferred embodiment, both of the flat bodies are trapezoidal so that, when lying on a flat plane the covering element has a trapezoidal shape that is tapered toward the upper edges of the flat bodies. This solution is especially useful in case of hip or ridge covering elements that in use partially overlaps each other. In fact, due to overlapping the flat portions of two adjacent covering element may not not lie on the same plane but on parallel planes, and if the external edges would be orthogonal to the upper and lower edges, a step can be formed and visible between the external edges of the adjacent covering elements. by means of said tapered shape, the external edges of overlapping covering element can provide an effect of a continuous edge thereby improving the aesthetic appearance of the roof covering.

The flat body comprises at least a beveled edge, preferably the inner edge. The beveled edge is inclined with respect to an upper surface of the flat body of at least 30°, preferably 45°. Said beveled edge is inclined so that it comprises an upper end placed in a proximal position from the other flat body of the covering element, and a lower end that is placed in a distal position from the other flat body of the covering element. In practice, when the covering element lies on a flat plane, the beveled edges of the two flat bodies of the covering element converge each other toward the upper surfaces of the flat bodies, and preferably contacts each other in correspondence of the upper surface. In this way, the angle between the flat bodies may be adjusted in such a way that the inner edges are never visible from a top view.

According to a preferred embodiment the flat bodies are made of the same material and in particular are made of a ceramic material, preferably porcelain. porcelain provides for a better frost and mechanical resistance with respect to other ceramic material. Moreover, porcelain is cheaper than natural slate. Anyway, it is not excluded that the bodies are made of other materials like, for example, natural stone, natural slate or metal.

Preferably the flat body, i.e. first and/or second flat body, comprises a glaze coating that covers at least the upper surface of the flat body. Hereby, it is noted that the glaze coating is not necessarily situated directly above the ceramic body, however, this is preferably the case. The glaze coating contributes to the overall weather and frost resistance of the flat body, since water can mainly only be absorbed via the edges of the flat body itself. Another advantage is that the flat body, due to the presence of the glaze coating, may be provided with a variety of textures, designs and colors. Other advantages that may be obtained by the presence of the glaze coating are the prevention or at least the minimization of moss grow, easy cleanability and/or UV-resistance.

Further, according to an embodiment of the invention, the glaze coating may cover at least one edge of the flat body, for example two or three edges of the flat body. In particular, since the covering elements are destined to be installed partially overlapping each-other, there can be always one edge of each flat bodies, namely an upper edge, that in use can be placed below another covering element and that consequently may not be exposed to weather and water. On the contrary the other three edges can be exposed to weather and water. By providing a glaze coating on said exposed edges is improved the overall weather and frost resistance of the roof tile. Preferably one or more of said exposed and glaze edges may be rounded or chamfered edges, for example they may be bullnose edges.

In a preferred embodiment, the glaze coating comprises a glaze layer of uniform color, which, in case of said glaze coating comprising a print, is situated below said print. As an advantage, the glaze layer of uniform color may hide imperfections in the upper surface of the ceramic body. Although the glaze layer of uniform color is preferably of a white, black, beige or grey color, the glaze layer may be of another color as well. In the latter case, the advantage may be obtained that the ink lay-up, which is needed for obtaining the desired colors in the aforementioned print, can be lowered.

Preferably, the glaze coating comprises a transparent or translucent glaze layer, which, in case of said glaze coating comprising a print, is arranged over said print. By having such glaze layer, the advantage may be obtained that the print can be protected from wear. Other advantages that may be obtained by the use of such transparent or translucent glaze layer are the minimization of moss grow, easy cleanability and/or UV-resistance. It is noted that the aforementioned glaze coating may be a so-called wet or dry glaze.

In case the flat body is made of a material different from ceramic, the flat body may comprise one or more coating layers different from glaze, for example a lacquer.

In a preferred embodiment, said glaze coating comprises a décor, which may simulate a natural product such as stone, natural slate or wood. In the latter case, the décor may show wood grains or wood nerves. As an advantage, the flat body, and as a consequence the covering element, may have the look of a natural product such as natural slate or wood, while being provided with better weather and frost resistance than roof elements that are actually made of such materials. In a particular embodiment, said décor comprises a print. In other words, the décor, or at least part of the décor, is provided by means of a printer or printing machine. Various techniques may be used to provide said print, such as screen printing, rotary serigraphy or digital printing, the latter technique being preferred. In case of digital printing, an inkjet printer may be used, which may be of the single pass type.

In case of the glaze coating being provided with a print, it is advantageous that the ceramic body substantially matches the general color or appearance of that print. Indeed, in that way, any substantial contrast between the edges of the ceramic body and the print may be excluded. For accomplishing that goal, the ceramic body may be provided with one or more color pigments. The pigments may then be chosen such that they provide the ceramic body with a color or appearance that substantially matches the color or appearance of the front face of the roof tile. It is noted that, in general, the ceramic body may be provided with one or more color pigments, irrespective of the ceramic body substantially matching the color or appearance of décor of the flat body.

In an embodiment, the upper surface of the flat body is provided with a relief, which preferably is formed by a plurality of excavations present in said upper surface of the flat body. By the relief, the texture of the flat body, at the upper surface thereof, may simulate the texture of a natural product such as stone, natural slate or wood. In the latter case, the relief may for example simulate the texture of wood grains or wood pores.

The relief or at least part of the relief may also concern one or more chamfers present at the upper surface of the flat body, which may be provided at one or more edges of the flat body. For example, the relief or at least part thereof may concern a chamfered perimeter of the flat body, for example in the form of a bullnose edge. Various possibilities may be applied for providing the relief. Preferably, the relief is formed in the upper surface of the ceramic body, in which case the relief manifests itself through the glaze coating up to the upper surface of the flat body. Alternatively, the relief or at least part of the relief may be formed in the glaze coating, such that it is situated substantially or completely above the ceramic body. In case of said glaze coating being provided with a print, said relief may be performed "in register" with said print, which means that the relief is in alignment with the print. By having the relief "in register" with the print, the natural look or appearance of natural products such as wood or natural slate is better simulated. For example, in case the print is a wood pattern with lines simulating wood grains, the relief may be formed by lines following the course of said lines of the printed wood pattern or by a plurality of successive dashes having a configuration following the lines of the printed wood pattern.

For having the relief being performed "in register" with the print, the techniques known from WO 2015/092745 A1 may be used.

Preferably, the thickness of the flat body is located between 5 and 20 mm, and more preferably between 7 and 15 mm, whereby a thickness of approximately 12 mm is still more preferred. Such thickness provides a good balance between, on the one hand, the weight of the covering element, and, on the other hand, the strength of the covering element itself. In particular, a thickness of about 12 mm has been found to be beneficial for the hail impact rating of the covering element 12 mm is a preferred thickness for covering elements destined to installations where hail impact resistance class 4 is useful or required, whereas in installation wherein said hail impact resistance class 4 is not necessary 8 mm is a preferred value for thickness in order to make a cheaper and lighter covering element.

The covering element is preferably provided with at least one attachment hole. Such attachment hole is used to attach or fasten the covering element to a roof structure or framework of the roof, said framework for instance being formed by battens, or by a beam. The attachment hole is a through hole.

As an advantage, the attachment hole allows a safe and secure installation of the covering element, for example by using nails, screws or wires. Moreover, the attachment hole allows a simple and efficient way to install the covering element.

In an embodiment, at least one attachment hole is present in at least one flat body of the covering element. For example, the attachment hole may be provided also in the flexible sheet, i.e. it may pass through the flexible sheet. According to a preferred embodiment, each flat body of the covering element comprises at least one attachment hole, preferably a plurality of attachment holes, for example two attachment holes. According to a preferred embodiment of the invention, the attachment holes of said plurality are aligned orthogonal to the upper edge of the roof tile, i.e. substantially parallel to the direction of the hip or ridge.

The attachment hole is preferably situated closer to the upper edge of the flat body than to the lower edge thereof. Still more preferably, the attachment hole is situated at a distance from the upper edge tile, as measured in the length direction of the flat body, which is smaller than 0.25 times the length of the flat body. As an advantage, in the installed configuration, the attachment holes can be covered by an overlapping covering element.

According to an embodiment of the invention in case the flat bodies are made of ceramic or porcelain, the attachment hole comprises a first enlarged portion and a second narrow portion, wherein the first enlarged portion is disposed close to the upper surface of the covering element. The first enlarged portion and the second narrow portion being coaxially each other. In this way, the enlarged portion defines a seat for the nail head and at the same time defines a guide for an ejecting nozzle of a nail gun so that the nail can be properly positioned and directed into the hole minimizing the risk of damaging the flat body.

It is noted that the feature that the angle between the flat bodies is adjustable forms and inventive concept from the flexible sheet. Therefore, according to a second independent aspect the invention provides for a roof ridge or hip covering element comprising a first and a second flat body and comprising a connecting element for joining together said first and a second flat body and wherein said connecting element is configured for adjusting an angle between said first and a second flat body. Therefore, the flexible sheet represents a preferred embodiment of the connecting element. Other examples for said connecting element, may be an elastomeric strip connecting the inner side of the flat bodies, or hinges connecting the flat bodies. It is noted that the covering element of said second independent aspect may comprise one or more of the features described in relation to the first independent aspect.

It is also noted that, a third independent aspect of the invention provides for a roof covering comprising a plurality of roof hip or ridge covering element, wherein each of said covering element comprises one or more of the features described above in relation to the first and second independent aspects.

Preferably said roof covering may comprise a plurality of roof tiles for covering the roof flaps of the roof. In this case it is preferred that said roof tiles comprise a ceramic body, for example made of porcelain, and optionally a glaze coating. In this case the roof tile may comprise one or more of the features described in the application WO 2017/132431.

The roof covering may also comprise an under layer disposed beneath the covering element. The under layer may provide additional functionalities to the covering element. As an advantage, it may be tailored, irrespective of the properties of the material of the flat bodies. Preferably, said under layer is made of a material different from ceramic or porcelain. In particular, said under layer may be made of one or more of the materials selected from the group consisting of: a thermoplastic polymer, such as polyvinylchloride, polyethylene, polypropylene and/or polyethylene terephthalate, a thermosetting polymer, such as polyurethane, and/or an elastomer, such as rubber or a thermoplastic elastomer. In case polyethylene is used as a material for said layer, low-density polyethylene or LDPE is preferred, although the use of high-density polyethylene or HDPE is not excluded. In this way the under layer is placed below the joints between the covering element, for example between the inner edges of the flat bodies of a same covering element, thereby improving impermeability of the roof covering.

A fourth independent aspect of the invention provides for a method for manufacturing a roof hip or ridge covering element, for example comprising one or more of the features described above in relation to the first and second independent aspects. The method comprises the step of: providing a first and a second flat body, providing a connecting element, for example a flexible sheet, and joining together said flat bodies via said connecting element thereby providing the roof ridge or hip covering element.

Said step of joining together said flat bodies via said flexible sheet, preferably comprises a step of gluing the flexible sheet to the first and second flat body. For example, the glue may be epoxy glue, polyurethane glue or, preferably, hot melt glue. According to an embodiment of the invention, the glue is provided in form of spots between the flexible sheet and the flat bodies, although it is not excluded that the glue is provided according to a pattern or in form of a uniform layer.

Said step of joining together the flat bodes may further comprise a step of pressing or laminating together said flat bodies and said flexible sheet, for example heat laminating.

According to a preferred embodiment wherein the covering element, and in particular the flat bodies, is made of ceramic, preferably porcelain, the step of providing flat bodies may comprise the steps of: providing a ceramic composition, preferably in powder form; forming, preferably pressing, said ceramic composition for forming a flat semi-product; firing the flat semi-product to obtain a flat body. The method may also comprise a step of providing the glaze coating, preferably onto the upper surface of said flat semi-product before said step of firing. Said step of providing the glaze coating preferably comprises also the step of providing the décor, preferably printing, more preferably digital printing via an ink jet printer.

The step of providing said flat bodies may be conducted in several possibilities, two of which are described here below.

According to the first possibility, the step of providing the first and second flat body, may comprise the step of manufacturing each of the first and second flat body independently, i.e. as a single piece. According to said embodiment the method may comprise the step of providing a rectangular flat semi-product and the step of cutting said rectangular flat semi-product thereby obtaining a trapezoidal flat body, for example cutting along a cutting line that is inclined to the inner edge to form the external edge. In case the flat body is made of ceramic or porcelain said cutting step is performed after firing. This is particularly advantageous in case the covering element is made of ceramic, and in particular in case it is made of porcelain. In fact, since porcelain is a highly vitrified ceramic material, during the firing step it is subjected to an important shrinkage, i.e. to a reduction of dimension. This shrinkage may be different on each edge of the porcelain body and therefore it is complicated to control the final dimension of the porcelain body. This is further enhanced in case of trapezoidal and generally non-rectangular or non-squared shapes. By manufacturing one rectangular porcelain flat semi-product and subsequently cutting the flat bodies it is easier to obtain a final product with the proper dimensions.

According to the second possibility the step of providing the first and second flat body, may comprise the steps of: providing a rectangular flat semi-product, cutting said flat piece thereby obtaining the first and a second flat body. According to an embodiment of said second possibility, the flat piece is rectangular and said step of cutting comprises a first cutting step for cutting the rectangular flat piece along a substantial median cutting line to obtain two rectangular flat portions, and a second cutting step for cutting each rectangular flat portion thereby obtaining two trapezoidal flat bodies. Said second cutting step is substantially the same described in the first possibility. Moreover, the first and second cutting step may be inverted. It is also possible that the flat piece is trapezoidal and that the cutting step comprises only the first cutting step of cutting along the median cutting line.

Said flat piece, manufactured according to the second possibility may comprise a front face decorated with multiple images representing the decors of a plurality of flat body, for example the decors of the two flat bodies of the covering element. This is particularly useful in case of a covering element made of porcelain so that the porcelain body of the flat piece is fired together with the glaze coating and the décor. These multiple images may be provided by respectively printing in certain areas of the upper surface of the flat piece. These images may be separated from each other by means of intermediate lines, transitions or edges, which are not necessarily provided by means of printing, although this is not excluded. In such front face, the borders or transitions between adjacent images may be represented by means of a relief. For example, as previously described, these borders or transitions may be formed by means of depressions in the upper surface of the flat piece, situated between the images of flat bodies. Thank to this solution it is possible to manufacture several flat bodies starting from one ceramic object thereby simplifying the ceramic process. Moreover, it is possible to manufacture one ceramic object, namely the flat semi-product and then tailoring the flat bodies according to the needs. For example, the flat bodies may be cut according to the desired shapes and dimensions.

It is noted that, said step of providing the first and second flat body may comprise the step of machining an edge of said flat body, in particular the inner edge of said flat body, for providing said beveled edge. In case the flat bodies are made of ceramic material, said machining is preferably done after firing. Anyway, it is not excluded that said beveled edge is provided before firing of the ceramic material, for example during the pressing step.

The step of providing the first and second flat body may also comprise the step of providing the attachment hole into said flat body. Said attachment hole may be drilled into the flat body. In a preferred embodiment, wherein the flat body is made of ceramic, preferably porcelain, the attachment hole is preferably provided into the flat body before a step of firing. For example, the attachment hole is provided into the flat body at the time of pressing a ceramic composition into a mold. In fact, fired ceramic materials, and in particular porcelain, are hard materials so that drilling is an expensive and complex process.

It is to be noted that the idea that the hip and ridge covering element is formed by two flat bodies, preferably made of ceramic material, forms an inventive idea independent from the other independent aspects described above. Therefore, according to this further independent aspect the invention relates to a roof hip and ridge covering element comprising a first and a second flat body. This provides the advantage of forming flat pieces to be connected together instead of manufacturing a unique piece having a complex shape.

According to a deviant embodiment of this further independent aspect the first and the second flat body may be fixed each other, for example in predetermined mutual position. Preferably said first and second flat bodies are attached each other to form an intermediate angle (measured between the lower surface of the flat bodies) of less than 180°, preferably less than 120°, for example 90°. For example, the first and the second piece can be glued each other, for example one edge of the first flat body can be glued to the edge or to the lower surface of the second flat body. Although, according to this further aspect the glue represents a preferred connecting element for attaching together the first and the second flat bodies, it is not excluded the use of alternative connecting elements like mechanical joints. It is also not excluded that the two flat bodies are formed separately as semi worked pieces and then connected each other to form a unique monolithic peace, for example by temporarily attach together two non-fired ceramic flat bodies and then firing together the flat bodies so that during firing they become a unique piece. This would provide the advantage of performing a simple pressing of the flat piece while resulting in a unique, strong, impermeable and aesthetically pleasant piece. In this way, it is possible to manufacture elements having a predetermined inclination for the most common roof structures while saving cost on the flexible sheet or element, but at the same time by manufacturing a covering element in a reliable way thanks to the simplified geometry of the flat pieces.

The roof hip and ridge covering according to this further aspect can comprise any of the features described in relation to the other aspects of the invention as well as being manufactured according to the method of the fourth aspect of the invention.

Figure 2:
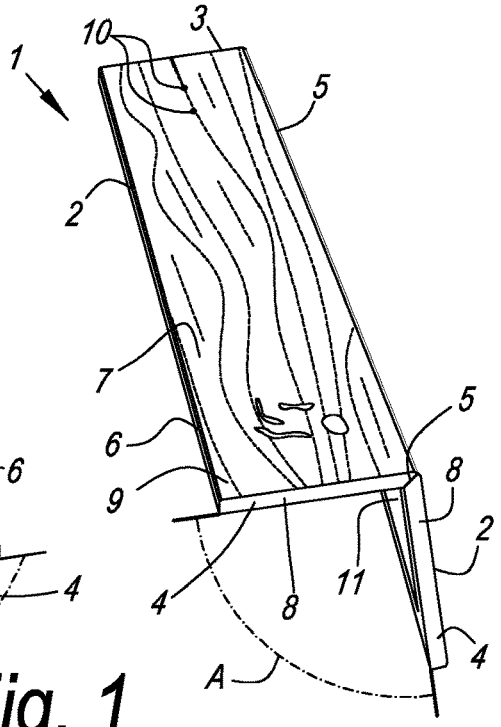
FIG. 2 represents a perspective view of the covering element of FIG. 1 in a second configuration.
Figure 3:
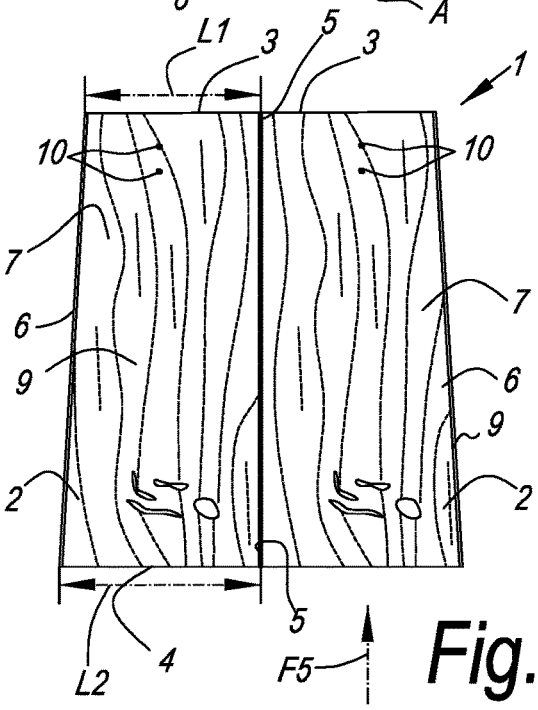
FIG. 3 represents top plane view of the covering element of FIG. 1.
Figure 4:
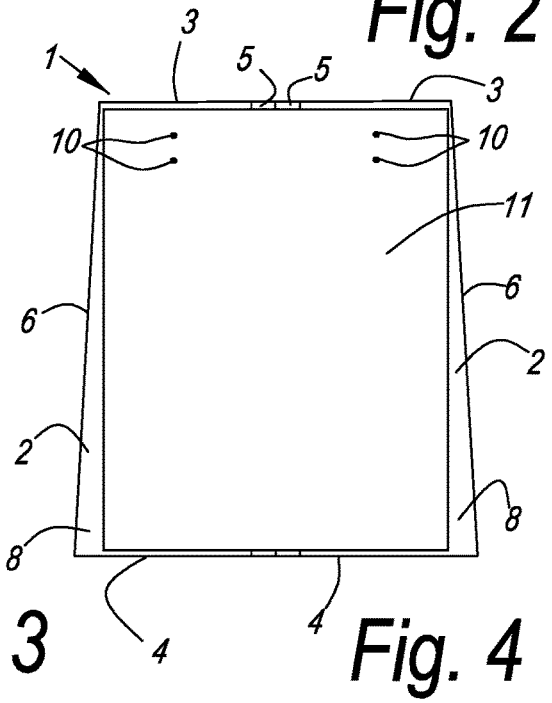
FIG. 4 represents bottom plane view of the covering element of FIG. 1.
Figure 5:
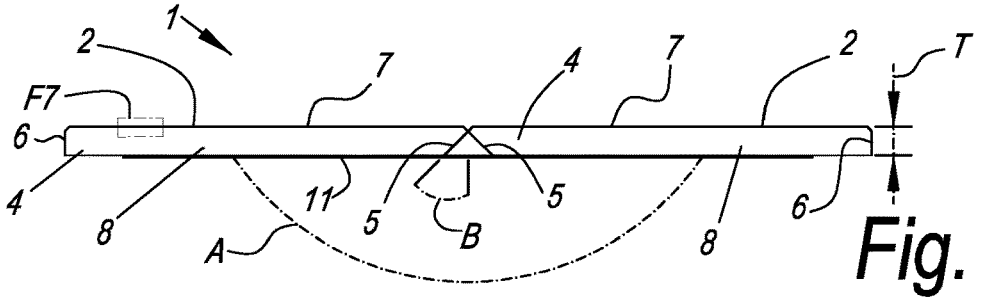
FIG. 5 shows an enlarged view according the direction F5 of FIG. 3.
Figure 6:
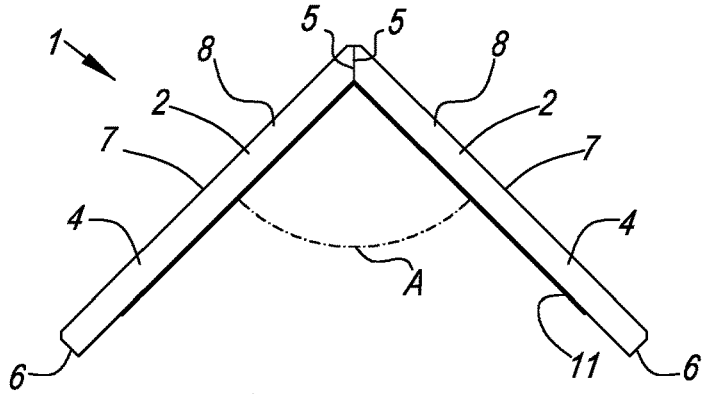
FIG. 6 represents the view of FIG. 5 with the covering element in a second configuration.
Figure 7:
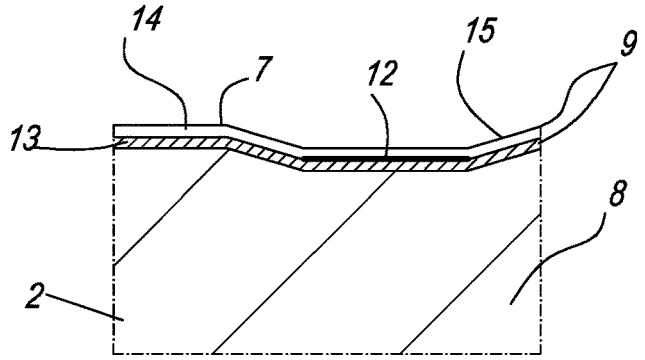
FIG. 7 represents an enlarged view of the section that is indicated with F6 in FIG. 5.
Figure 8:
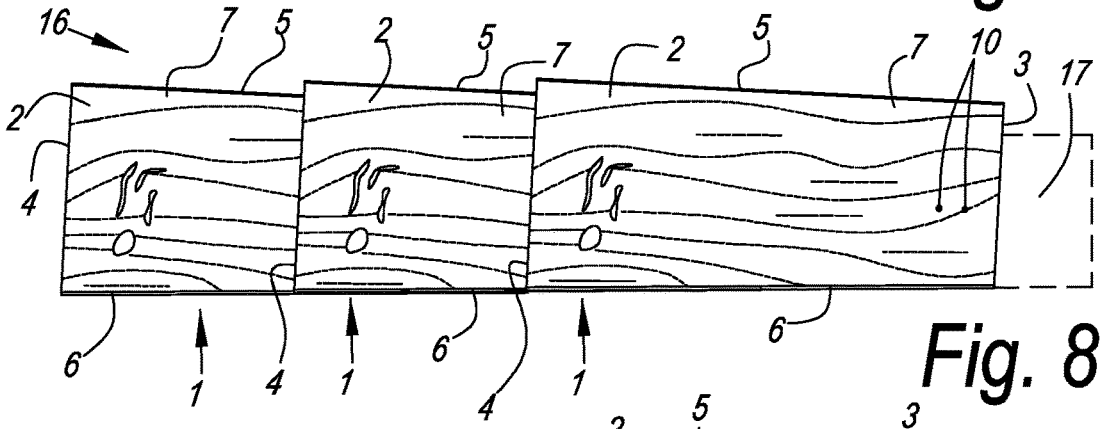
FIG. 8 represents a side view of a roof ridge covering according to the disclosure.
Figure 9:
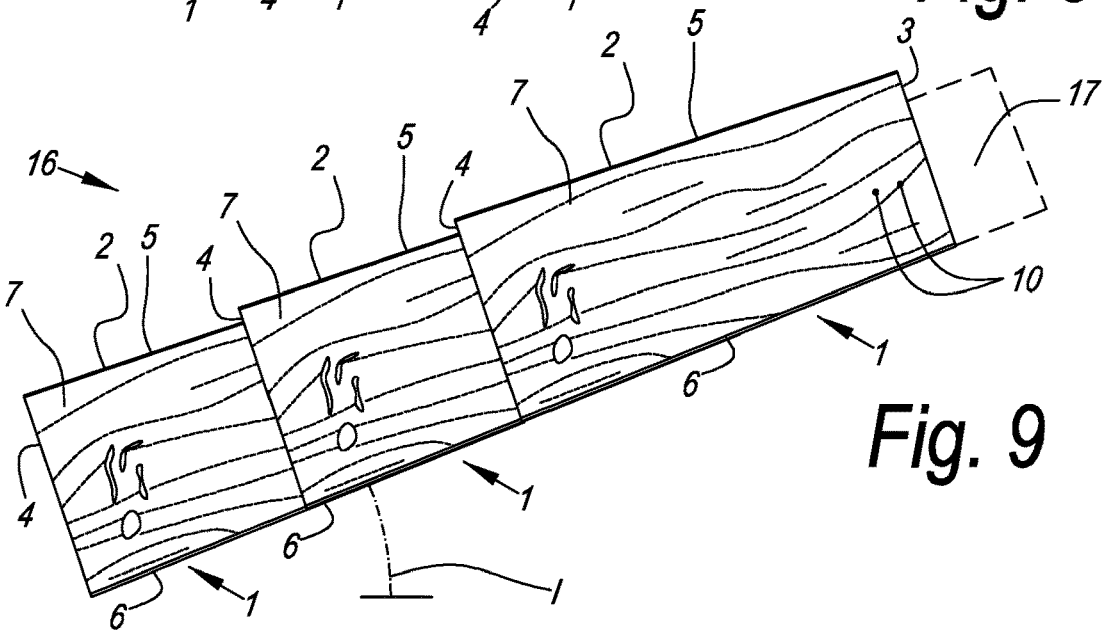
FIG. 9 represents a side view of a roof hip covering according to the disclosure.

With the intention of better showing the characteristics of the invention, the following non-limiting possible embodiments are described with reference to the accompanying drawings, wherein:

FIG. 1 represents a perspective view of a hip and ridge covering element according to the present invention in a first configuration;

FIG. 2 represents a perspective view of the covering element of FIG. 1 in a second configuration;

FIG. 3 represents top plane view of the covering element of FIG. 1;

FIG. 4 represents bottom plane view of the covering element of FIG. 1;

FIG. 5 shows an enlarged view according the direction F5 of FIG. 3;

FIG. 6 represents the view of FIG. 5 with the covering element in a second configuration;

FIG. 7 represents an enlarged view of the section that is indicated with F6 in FIG. 5;

FIG. 8 represents a side view of a roof ridge covering according to the invention;

FIG. 9 represents a side view of a roof hip covering according to the invention;

Figures from 10A to 10E show some steps of a method for manufacturing a covering element.

FIG. 1 represents a perspective view of a roof hip and ridge covering element 1 according to the present invention, with a view on the front face of the covering element 1 in a flat configuration.

The covering element 1 comprise a first and a second flat body 2. Each of the flat bodies 2 comprise a trapezoidal shape. It has an upper surface 3 and a lower surface 4, whereby, in the installed condition of the covering element 1, especially in case of a hip covering (see FIG. 9), the upper surface 3 is directed upwards, whereas the lower surface 4 is directed downwards. The flat body 2 further comprise an inner edge 5 facing the other flat body 2 and an external edge 6 opposite with respect to the other flat body 2.

The upper surface 7 forms the decorative surface of the flat body 2.

Each flat body 2 comprises a ceramic body 8, which is made of porcelain, and a glaze coating 9, which is situated above said ceramic body 8. The glaze coating 9 comprises a décor, which here simulates wood, for example showing wood nerves and wood pores.

Each flat body 2 is provided with at least one attachment hole 10. Here, the flat bodies 2 are provided with a plurality of attachment holes 10. The attachment holes 10 are present in at least the ceramic body 8 of the flat bodies 2. They are situated closer to the upper edge 3 of the flat body 2 than to the lower edge 4 thereof.

The covering element 1 further comprises a flexible sheet 11 joining together the two flat bodies 2 disposed below said flexible bodies 2. The flexible sheet 11 is configured to for adjusting an intermediate angle A between said first and a second flat body 2.

The angle intermediate A between the flat bodies 2 can take any value between 0° and 360°, for example between 90° and 180°. In FIG. 1 is shown the covering element in a flat configuration wherein said angle A is of 180°.

FIG. 2 represents a perspective view of the covering element of FIG. 1 in a second configuration wherein the intermediate angle A is of 90°.

FIG. 3 represents top plane view of the covering element of FIG. 1.

The inner edge 5, of each flat body 2 is substantially orthogonal to the upper edge 3 and the lower edge 4. In FIG. 3 is shown a configuration wherein the inner edges 5 of the flat bodies 2 are in contact each other, although it is not excluded that, according to alternative embodiments, the inner edges 5 are distanced from each other, i.e. not in contact.

The external edge 6, of each flat body 2, is inclined relative to the upper edge 3 and the lower edge 4 of an angle different from 90°. Preferably, the upper edge 3 has a length L1 that is lower to the length L2 of the lower edge 4.

FIG. 4 represents a bottom view of the covering element of FIG. 1.

The flexible sheet 11 is placed below the flat bodies 2, for example it is totally overlapped by the flat bodies 2.

According to a preferred embodiment, the flexible sheet 11 may be in form of a web, for example of a synthetic fiber or glass fiber. According to alternative embodiment the flexible sheet 11 may be an impermeable sheet, for example of polyethylene or other polymeric material.

As visible from FIG. 4 the attachment holes 10 are through hole that passes through holes that pass the entire thickness flat bodies 2 and even pass through the flexible sheet 11.

FIG. 5 shows an enlarged view according the direction F5 of FIG. 3.

Each flat body 2 comprises a beveled inner edge 5 facing the other flat body 2. The inner edge 5 is inclined with respect to the upper surface 7 of the flat body 2 of a beveling angle B of at least 30°, preferably 45°. As shown in FIG. 5, when the covering element 1 lies on a flat plane, i.e. the intermediate angle A is 180°, the inner edges 5 of the two flat bodies 2 of the covering element 1 converge each other toward the upper surfaces 7 of the flat bodies 2, and preferably contacts each other in correspondence of the upper surface 7.

The thickness T of the flat body 2 is preferably located between 5 and 20 mm, more preferably between 7 and 15 mm, and still more preferably the thickness T is approximately 8 mm or 12 mm. 12 mm is a preferred thickness T for covering elements 1 destined to installation wherein a hail impact resistance class 4 is useful or required, whereas in installation wherein said hail impact resistance class 4 is not required 8 mm is a preferred value for thickness T in order to make a cheaper and lighter covering element 1.

FIG. 6 represents the view of FIG. 5 with the covering element 1 in a configuration wherein the intermediate angle A is 90°. As can be seen from this FIG. 6 such configuration is permitted by the flexible sheet 11 and also by the beveled inner edges 5.

FIG. 7 represents an enlarged view of the section that is indicated with F6 in FIG. 5.

The glaze coating 9 comprises a décor, said décor comprising a print 12, a glaze layer 13 of uniform color, which is situated below the print 12, and a transparent or translucent glaze layer 14, which is arranged over said print 12. It is noted that according to alternative examples the glaze coating 9 may be free from said transparent or translucent glaze layer 14 and/or from said print 12.

The upper surface 7 of the flat body 2 is provided with a relief 15, which, in the represented example, is formed by a plurality of excavations present in said upper surface 7. According to the present embodiment the relief 15 is formed in the ceramic body 8 and manifest itself through the glaze coating 9, although according to non-showed embodiments the relief 15 may be at least partially formed directly in the glaze coating 9.

FIG. 8 represents a side view of a roof ridge covering 16 comprising a plurality of covering elements 1 as described above. The covering elements 1 are installed above a roof structure or a roof frame 17. The covering elements 1 are attached or fastened to roof frame 17 by means of nails or screws which are put in the attachment holes 10

The covering elements 1 are in a bent configuration wherein the intermediate angle A is lower than 180°, for example is 90° as shown in FIGS. 2 and 6. The covering elements 1 are partially overlapped each other to improve impermeability of the roof covering. In this overlapped configuration each covering element 1 covers and hides the attachment holes 10 of the covering element 1 below. It is noted that the covering elements 1 are overlapped so that the lower edge 4 is visible and the upper edge 3 is placed below and overlapping covering element 1.

It is noted that due to the trapezoidal shape of the flat bodies 2, in this overlapped configuration the external edges 6 of the overlapping covering 1 elements are substantially parallel so as to give the impression of a unique edge of the roof ridge covering 16.

FIG. 9 represents a side view of a roof hip covering according to the invention.

In FIG. 9, I denotes the inclination of the roof hip, for example of the roof structure 17 with respect to the horizontal. It is noted that the covering elements 1 are overlapped so that the lower edge 4 is visible and the upper edge 3 is placed below and overlapping covering element 1. Also, in this case, it is noted that thanks to the trapezoidal shape of the flat bodies 2, in this overlapped configuration the external edges 6 of the overlapping covering 1 elements are substantially parallel sot to give the impression of a unique edge of the roof ridge covering 16.

Figures from 10A to 10E show some steps of a method for manufacturing the covering element 1.

Figure 10A:
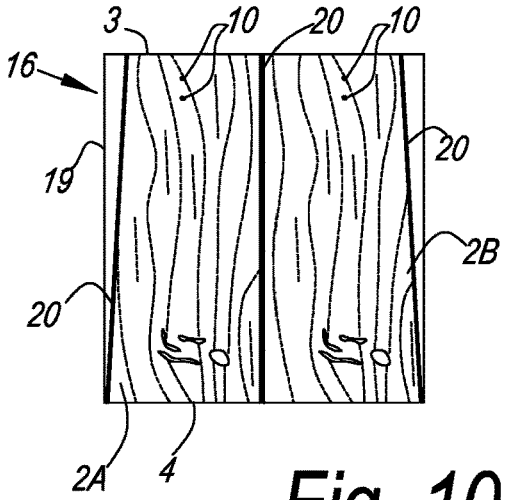
FIGS. 10A to 10E show some steps of a method for manufacturing a covering element.

FIG. 10A shows a first step of providing a rectangular flat semi-product 18. The rectangular flat semi-product 18 comprises a fired porcelain body 19 and is provided with the glaze coating 9 on the upper surface 7.

In the represented example, the front face of the rectangular flat semi-product 18 represents or forms an image of a plurality of trapezoidal flat bodies 2A, 2B. The borders of, or the transition between, the images of the trapezoidal flat bodies 2A, 2B are formed by depressions 20.

Although, in the represented example, the front face of the rectangular flat semi-product 18 represents or forms an image of two trapezoidal flat bodies 2A, 2B, it is not excluded that less or more than two trapezoidal bodies 2A, 2B are represented. It is also not excluded that the front face of the rectangular flat semi-product 18 represents a rectangular flat body 2A, 2B instead of a trapezoidal flat body 2A, 2B.

According to a preferred embodiment, the attachment holes 10 are provided in the rectangular flat semi-product 18 before firing of the porcelain body 19. Any it is not excluded the method comprise a step of providing said attachment holes 10 after firing.

Figure 10B:
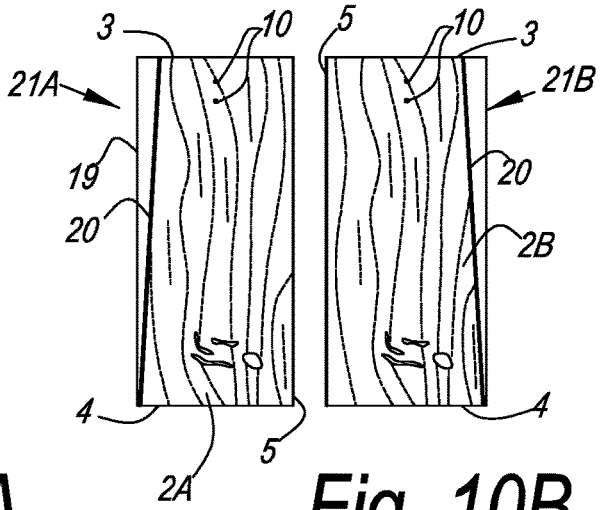

FIG. 10B shows a second step of cutting the rectangular flat semi-product 18 along a median cutting line, for example substantially coinciding with one depression 20, thereby providing two rectangular half-processed flat bodies 21A, 21B. By cutting along the depression 20 the inner edges 5 are formed.

Each of the half-processed flat bodies 21A, 21B comprises, on its front face one image of trapezoidal flat bodies 2A or 2B.

Figure 10C:
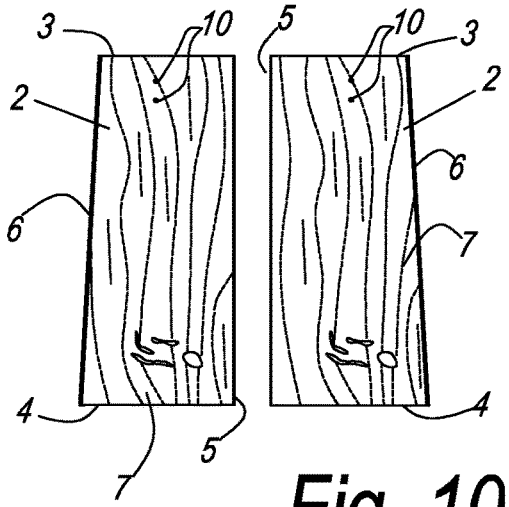

FIG. 10C shows a second step of cutting the half-processed flat bodies 21A, 21B along a cutting line that are inclined to the inner edge 5 to form the external edges 6, and thereby providing the trapezoidal flat bodies 2. Said inclined cutting line are coinciding with depressions 20.

Figure 10D:
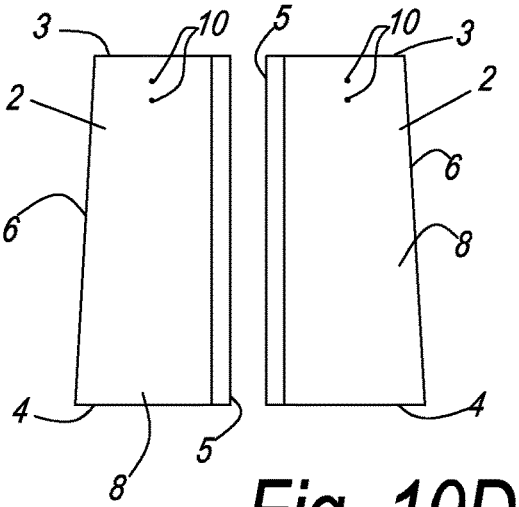

FIG. 10D shows a step of machining the inner edges 5 of each flat body 2 for forming the beveled edge. Said step of machining may be conducted either before or after, or even contemporarily to the step of forming the external edges 6 shown in FIG. 10C, as well as contemporarily to the step of cutting the rectangular flat semi-product 18 for forming the inner edges 5, shown in FIG. 10B.

Figure 10E:
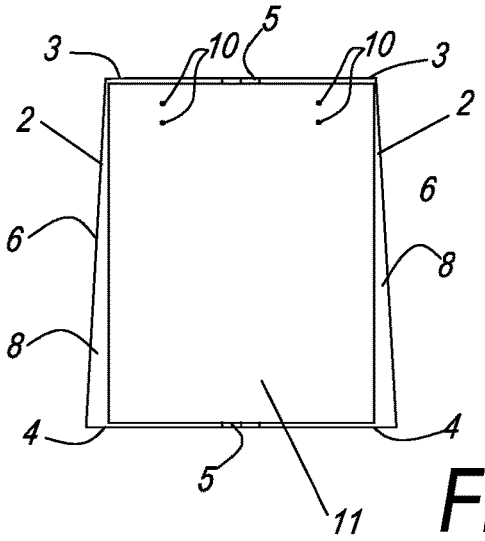

FIG. 10E shows a step of the method wherein the flat bodies 2 are joined together by the flexible sheet 11. During said step of joining the flexible sheet 11 is fixed to the lower surfaces of the ceramic bodies 8.

The flexible sheet 11 and the ceramic bodies 8 may be laminated or press laminated together, for example by means of glue such as epoxy glue or hot melt glue.

The present invention is in no way limited to the hereinabove described embodiments, but such system may be realized according to different variants without leaving the scope of the present invention. While certain systems and methods related to composite tile systems and methods have been disclosed in some exemplary forms, many modifications, additions, and deletions may be made without departing from the spirit and scope of the system, method, and their equivalents. The embodiments disclosed herein are further capable of other embodiments and of being practiced and carried out in various ways. Also, it is to be understood that the phraseology and terminology employed herein are for the purposes of description and should not be regarded as limiting the claims.

Accordingly, those skilled in the art will appreciate that the conception upon which the application and claims are based may be readily utilized as a basis for the design of other devices, methods, and systems for carrying out the several purposes of the embodiments and claims presented herein. It is important, therefore, that the claims be regarded as including such equivalent constructions.

What is claimed is:

1. A method for manufacturing a roof ridge or hip covering element comprising the steps of:

providing a flat piece comprising a ceramic body;

digitally printing, on the flat piece, a décor representing a first flat body and a second flat body separated by a transition line;

firing the flat piece;

cutting the fired flat piece along the transition line to obtain the first flat body and the second flat body;

providing a flexible sheet comprising a fiberglass web;

joining the first and second flat bodies together via the flexible sheet, the joined first and second flat bodies providing the roof ridge or hip covering element; and providing two attachment holes for each of the first and second flat body that are disposed close to an upper edge of the flat body and are aligned along a line that is substantially orthogonal to the upper edge.

2. The method according to claim 1, comprising the step of providing at least one attachment hole into the flat piece before firing.

3. The method according to claim 1, comprising the step of providing at least one attachment hole into the flat bodies.

4. The method according to claim 1, comprising the step of machining at least one edge of the flat bodies.

5. The method according to claim 4, wherein the beveled edge is inclined with respect to an upper surface of the flat body of at least 30°.

6. The method according to claim 1, wherein the transition line is in the form of an excavation on the upper surface of the flat piece.

7. The method according to claim 1, comprising the step of providing a glaze onto the flat piece.

8. The method according to claim 1, wherein the step of joining comprises the step of gluing the flexible sheet to the first and second flat body.

9. The method according to claim 8, wherein the flexible sheet is glued to a lower surface of the first and second flat bodies.

10. The method according to claim 4, wherein the beveled edge is inclined with respect to an upper surface of the flat body of 45°.

11. The method according to claim 1, wherein the décor comprises a natural stone, slate or wood pattern.

* * * * *